United States Patent [19]

Segatz

[11] Patent Number: 4,840,293

[45] Date of Patent: Jun. 20, 1989

[54] APPARATUS FOR DISCHARGING A BEAD OF PASTY MATERIAL FROM A FLEXIBLE BAG

[75] Inventor: Wilhelm Segatz, Zell, Fed. Rep. of Germany

[73] Assignee: ARA - Werk Krämer GmbH & Co., Fed. Rep. of Germany

[21] Appl. No.: 76,496

[22] Filed: Jul. 22, 1987

[30] Foreign Application Priority Data

Jul. 30, 1986 [DE] Fed. Rep. of Germany ..... 8620379
Apr. 4, 1987 [DE] Fed. Rep. of Germany ..... 8705030

[51] Int. Cl.[4] ..... B65D 88/54

[52] U.S. Cl. ..... 222/94; 222/326; 222/340; 222/386

[58] Field of Search ..... 222/94, 95, 340, 341, 222/326–327, 389, 568, 569, 108, 386, 386.5, 571

[56] References Cited

U.S. PATENT DOCUMENTS

| | | | |
|---|---|---|---|
| 2,923,442 | 2/1960 | Maras | 222/327 |
| 3,029,985 | 4/1962 | Krueger | 222/327 |
| 3,136,456 | 6/1964 | Sherbondy | 222/389 X |
| 3,215,320 | 11/1965 | Heisler | 222/326 X |
| 3,980,209 | 9/1976 | Collar | 222/323 |
| 4,376,498 | 3/1983 | Davis, Jr. | 222/326 |

FOREIGN PATENT DOCUMENTS

| | | | |
|---|---|---|---|
| 1263356 | 12/1961 | France | 222/327 |
| 1371662 | 10/1974 | United Kingdom | 222/389 |
| 2088998 | 6/1982 | United Kingdom | 222/95 |
| 2090336 | 7/1982 | United Kingdom | 222/95 |
| 2186554 | 8/1987 | United Kingdom | 222/95 |

*Primary Examiner*—Joseph J. Rolla
*Assistant Examiner*—Gregory L. Huson
*Attorney, Agent, or Firm*—Steele, Gould & Fried

[57] ABSTRACT

An apparatus for discharging a bead or strand of pasty material from a deformable tubular container such as a tubular bag has a bag-loadable cylinder with a front face pointing in a discharge direction, the front face having a central opening aligned with a nozzle connection of the tubular bag. A substantially piston-like pressure member is axially displaceable against the tubular bag in the cylinder. In order to avoid drooling and dribbling of material through the nozzle after interruption of the discharge process, and also to prevent jamming of the edges of the tubular bag, the pressure member has a pressure relief spring supported on the wall of the cylinder and cooperating therewith, the spring having spring tongues directed obliquely forward around the deformable bag.

22 Claims, 3 Drawing Sheets

FIG. 2
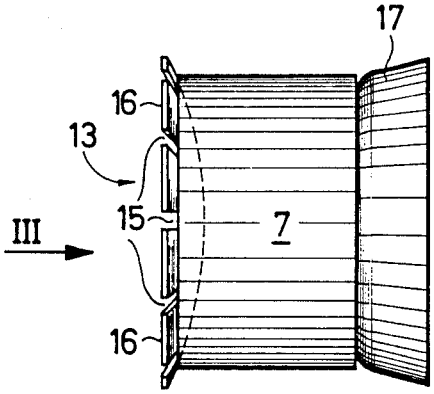
FIG. 4
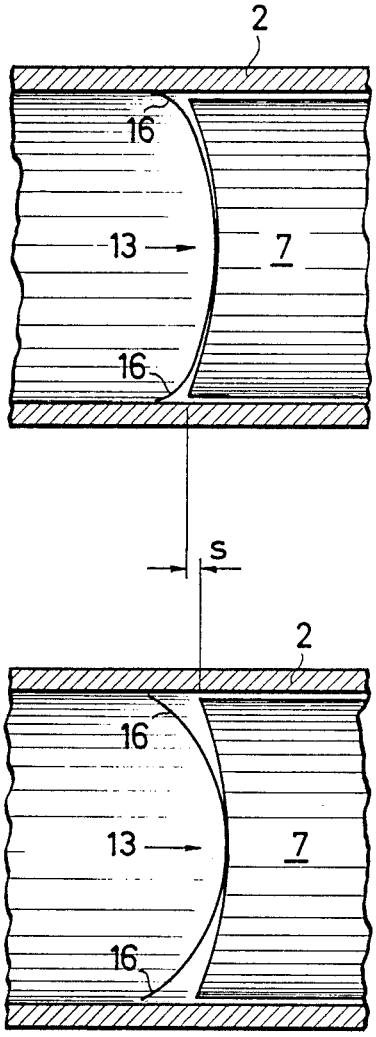
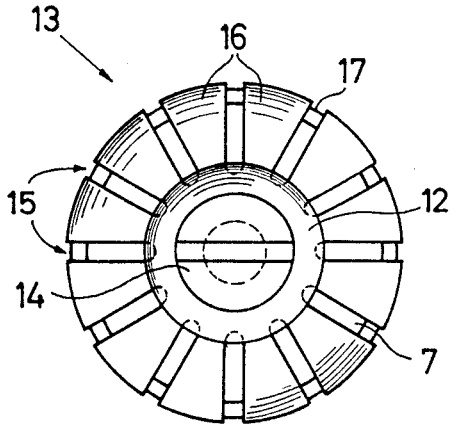
FIG. 3
FIG. 5

FIG. 6
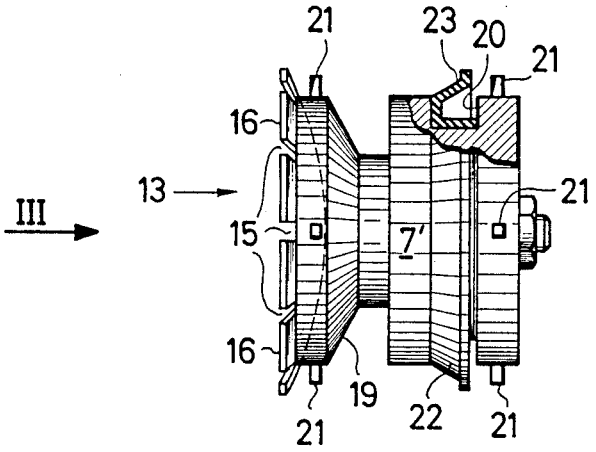
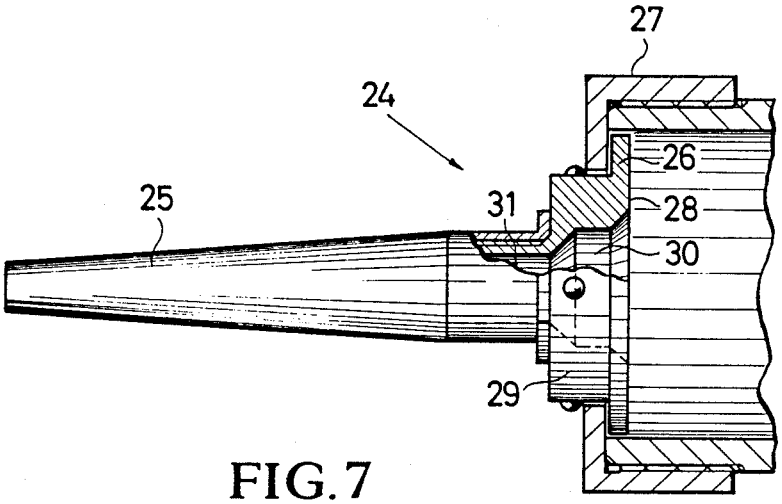
FIG. 7

APPARATUS FOR DISCHARGING A BEAD OF PASTY MATERIAL FROM A FLEXIBLE BAG

BACKGROUND OF THE INVENTION

The invention relates to an apparatus for discharging a bead or strand of pasty materials contained in deformable tubular containers such as hose segments or tubular bags. A bag-loadable cylinder, whose front face points in a discharge direction, has a central opening or outlet aligned with the nozzle connection of the tubular bag. A substantially piston-like thrust or pressure member is axially displaceable against the tubular bag in the cylinder by means of a device for the axial displacement of the pressure member.

When using such a generally gun-like apparatus, a small amount of the material to be discharged from the bag normally drools or dribbles out of the nozzle at the end of the discharge process and after each interruption of the discharge process. This uncontrolled discharge of the tubular bag contents means that prior to each usage and after every interruption, the implement always must be cleaned at the front, which is time-consuming and leads to unnecessary and wasteful loss of tubular bag contents.

An object of the present invention is to so improve an apparatus for discharging a bead from a bag that it is possible to work without the aforementioned uncontrolled discharge of tubular bag content.

According to the invention, this object is achieved in an apparatus of this type by providing the pressure member with a pressure relief spring supported on the cylinder wall and cooperating therewith.

As a result of this spring, following the pressure relief of the pressure member, i.e., at the end of a discharge or during an interruption of the discharge process, said pressure member does not remain in its working position and is instead retracted by an amount dependent on the spring travel. The tubular bag content is then no longer pressurized and there is nothing forcing the material to drool or dribble out in an uncontrolled manner. The free end of the pressure relief spring is displaceable under friction along the inner wall of the cylinder.

The pressure relief spring of the invention, due to the action which it exerts on the pressure member at the end or during an interruption of the discharge process, could also be called a return or restoring spring. The spring is preferably provided on the discharge-side front face of the pressure member. However, it would also be possible to provide a correspondingly constructed spring on the circumference of the pressure member or on its end face remote from the tubular bag. However, preferably the pressure relief spring is positioned on the discharge-side front face of the pressure member, because as a result it is possible to prevent without difficulty any jamming of the tubular bag between the pressure member and the cylinder inner wall.

If the pressure relief spring is provided on the discharge-side front face of the pressure member, it is preferably flat and constructed in such a way that it fits the piston-side end of the tubular bag and is preferably provided with radial spring tongues. The pressure relief spring is, e.g., constructed in strip-like or star-shaped manner.

In a preferred embodiment, on a side of the pressure member directed towards the tubular bag, the pressure member carries a spring washer provided with spring tongues defined by radial slits, and the external diameter of said washer prior to the insertion of the pressure member in the cylinder (i.e., when relaxed) is larger than the internal diameter of the cylinder, so that after the insertion of the pressure member, the spring tongues are resiliently supported against the cylinder's inner wall. The dimensions of the spring, e.g., the external diameter of the aforementioned spring washer, is preferably 8 to 12 percent greater than the internal diameter of the cylinder. The marginal portions of the spring washer are preferably directed away from the pressure member, i.e., the spring tongues run in the direction of the tubular bag.

On the side of the pressure member directed in the discharge direction, i.e., pointing towards the tubular bag, the pressure member can be concave. The radius of the resulting hollow or cavity is preferably smaller than the radius of the fixed spring. The hollow or cavity is unloaded in the pressure direction.

At least in the vicinity of its spring tongues, the pressure relief spring is preferably resiliently raisable from the pressure member. The pressure relief spring is attached to the pressure member, preferably by means of a central, axially-directed screw, preferably accompanied by an interposed shim. The spring can be made from a springy plastic, preferably polyethylene. Compared with rubber, which would resist free sliding motion of the pressure member against the cylinder, a springy plastic gives the advantage that it only causes minimal friction. Therefore, it is always possible to work with a contact pressure on the bag substantially corresponding to the working pressure on the pressure member.

A pneumatically operating device can be provided to force axial displacement of the pressure member in the cylinder. In that event, the pressure member is sealed with respect to the cylinder inner wall by means of an elastic seal. The elastic seal has an external diameter prior to the insertion in the cylinder (i.e., when relaxed) that is preferably larger than the internal diameter of the cylinder. In one embodiment said seal is constructed as a packing ring and is placed on the end face of the pressure member remote from the tubular bag.

The preferably-plastic pressure member can have one or more circumferential grooves. As a result, the pressure member is lighter and can be more easily displaced. According to a preferred embodiment such a groove, which in particular extends around the circumference of the pressure member in a central region, contains an elastic seal ring acting radially against the inner wall of the cylinder. If there is a pneumatically operating device for the axial displacement of the pressure member, then said seal ring can have a sealing lip arranged to expand under compressed air action, so that the pressure member can be inserted in the cylinder without difficulty, but an optimum all-round sealing is still ensured during the working process. The seal ring is preferably constructed as a profile ring having a small contact surface area disposed against the cylinder inner wall, which area is substantially independent of the compressed air action. As a result, friction is kept small.

In order to prevent tilting of the pressure member relative to the cylinder, the external diameter of the pressure member can be substantially adapted to the internal diameter of the cylinder. Tilting of the pressure member within the cylinder also can be prevented with particular advantage by means of guide cams provided on the pressure member. The cam guides are distributed in at least one plane and preferably in two planes and in uniform manner about the pressure member circumference. The guide cams ensure a secure, low-friction guidance of the pressure member within the cylinder. The two planes are preferably disposed on opposite sides of the seal ring.

The cylinder of the apparatus according to the invention can be provided at its discharge end with a cover detachably connected thereto, preferably by threads. The cover has a central opening which passes into a discharge nozzle, which nozzle can be fixed to the cover by threads. On its inside said cover preferably has a planar bearing face for the tubular bag. A depression is preferably provided in the center of the planar bearing face for receiving the edge of the cut-open bag. The depression preferably leads conically into the central opening or outlet. The planar bearing face offers the advantage that under the action of the pressure member acting thereon, the tubular bag can be substantially completely emptied. The aforementioned cover can have an external, substantially-cylindrical shoulder for threadable attachment to the discharge nozzle, said shoulder preferably having an external thread, particularly such that conventional cartridge nozzles can be threaded thereto. The internal diameter of the outlet in the shoulder is preferably so dimensioned that it substantially corresponds to the outlet of conventional cartridges. Therefore the conditions can be that same as those when dealing with cartridges.

The aforementioned cover is preferably constructed in two parts, one cover part being formed by a retaining nut and the other cover part by a connecting piece having the aforesaid planar bearing face for the tubular bag. The connecting piece also preferably has the depression used for receiving the edge of the cut-open bag. Such a two-part cover construction offers the advantage that the cylinder can be opened without rotating the connecting piece. In the case of a necessary color change or the like, the tubular bag can at any time be interchanged, i.e., including before it is finally emptied, by removing and replacing it together with the connecting piece associated therewith in the cover and the discharge nozzle connected thereto. One simply installs a new tubular bag having a different connecting piece. The aforementioned connecting piece is preferably dimensioned in such a way that it is at least partly frontally insertable into the cylinder interior. Between the two cover parts, that is between a retaining nut and the connecting piece, it is possible to provide a locking connection, which prevents any unintentional axial detachment of the two cover parts.

Further details, features and advantages of the invention, which can be realized alone or in the form of combinations in an embodiment of the invention, can be gathered from the claims and the following description of a preferred embodiment of the invention.

BRIEF DESCRIPTION OF THE DRAWINGS

FIG. 2 is a larger-scale side view of the pressure member of the apparatus according to FIG. 1.

FIG. 3 is a view of the pressure member shown in FIG. 2, in a direction shown by arrow III.

FIG. 4 shows the position of the pressure member of the apparatus shown in FIG. 1, during the discharge process.

FIG. 5 shows the position of the pressure member of the apparatus shown in FIG. 1 at the end of the discharge process.

FIG. 6 is part sectional, larger-scale side view of another embodiment of the pressure member of the apparatus according to FIG. 1.

FIG. 7 shows a threaded cover with a discharge nozzle.

DETAILED DESCRIPTION OF THE PREFERRED EMBODIMENTS

Figure 1:
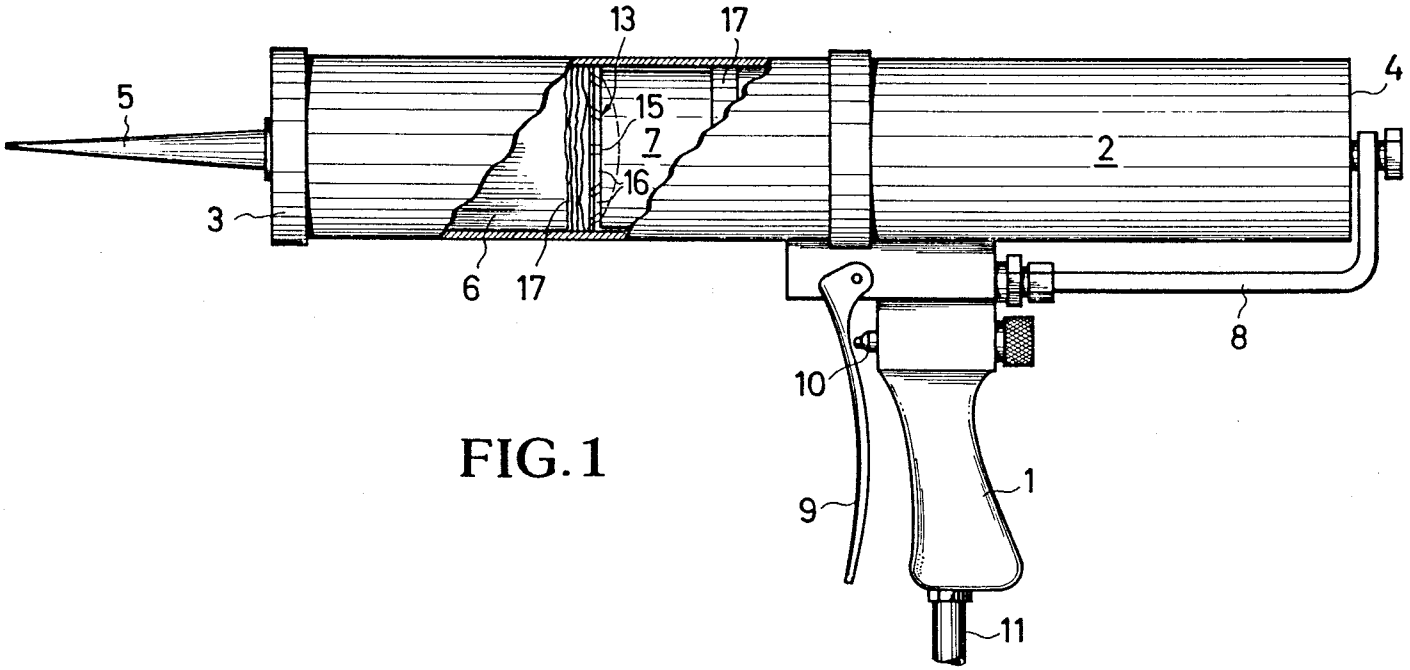
FIG. 1 is a part sectional side view of an apparatus according to the invention.

The apparatus shown in FIG. 1 is constructed to generally resemble a gun and has a handle 1 and a cylinder 2 carried by the handle. At the left-hand end in the drawing, cylinder 2 is provided with a threaded cover 3 and at its opposite end with a base 4. Threaded cover 3 has a central opening, which leads into a discharge nozzle 5. After unscrewing cover 3, the cylinder 2 can be loaded with a tubular bag 6 containing a pasty material. A pressure member 7 is tightly guided within cylinder 2 and is subject to the action of compressed air from a side remote from the threaded cover 3, and which can be supplied to cylinder 2 via line 8. Line 8 connects an adjustable compressed air valve 10 to the base 4 of cylinder 2. Valve 10 is located in handle 1 and is operable by means of a lever 9. A compressed air line 11 issuing at the bottom in handle 1 leads to the compressed air valve 10. Cylinder bottom 4 contains a pressure relief valve, which reduces the overpressure in the cylinder if the compressed air supply is interrupted.

The front face of the substantially piston-like pressure member 7 directed towards the threaded cover 3 is concave and, with interposed shim 12, is attached by means of a central screw 14 to a spring washer 13, made from springy plastic. Spring washer 13 is circular in plan view as shown in FIG. 3, and is provided with twelve radially directed slits 15, subdividing the marginal region into twelve radially-directed spring tongues 16. After attaching spring washer 13 to pressure member 7, by means of a screw, the diameter of said washer is approximately 10 percent larger than the internal diameter of cylinder 2.

The end face of the pressure member 7, remote from the threaded cover 3, is provided with an elastic, preferably resiliently constructed packing ring 17, whose external diameter, prior to the insertion in cylinder 2, is larger than the internal diameter of the cylinder, so that it ensures a tight guidance of pressure member 7 in cylinder 2.

During the discharge process, the spring tongues 15 are crushed somewhat and pressed into the cavity of pressure member 7 as shown in FIG. 4. At the end of the discharge process, the spring tongues 15 are supported against the inner wall of cylinder 2 and also against the folded, compressed outer region of the tubular bag. The spring fingers force the pressure member 7, which is no longer subject to compressed air action, to retract by an amount "s" in the direction of bottom 4 of cylinder 2 as shown in FIG. 5. The result of this is that the content of tubular bag 6 is no longer under pressure and consequently has no reason to drool or dribble out the nozzle 5. Due to the fact that the spring tongues slide obliquely forwards in the discharge direction under pretension in the cylinder wall, any jamming of the tubular bag wall on the pressure member is avoided, such as occurs with known pressure members having two facing packing rings.

The sectional pressure member 7′ in FIG. 6 carries spring washer 13 on its front face, pointing to the left in the drawing. Spring washer 13 has radially directed slits 15 and radially directed spring tongues 16, defined between said slits. The pressure member 7′, shown in FIG. 6, has a smaller diameter than the pressure member 7 shown in FIG. 2 and, unlike the embodiment of FIG. 2, does not have a cylindrical circumferential surface. It is, in fact, provided with two circumferential grooves 19, 20, and on the outer edge adjacent the front and rear-end faces with guide cams 21. Four guide cams are provided at the front and four at the rear. In the groove 20, furthest from the spring washer 13, is provided a profiled ring seal 22 having a sealing lip 23, which can be widened by compressed air action, and which has a narrow, circumferential sealing edge.

Cover 24 as shown in FIG. 7 has a connecting piece 26 threaded to a discharge nozzle 25 and also a retaining nut 27. On the side of connecting piece 26 remote from discharge nozzle 25, connecting piece 26 has a planar tubular bag bearing face 28 and on the other side a two-stage shoulder 29, which is assembled by means of threads to discharge nozzle 25. In the center of bearing face 28 is provided a depression 30, used for receiving the edge of a cut-open bag, which has its extension in a central opening 31 of shoulder 29 and therefore communicates with discharge nozzle 25.

I claim:

1. An apparatus for discharging a strand of pasty materials from a deformable tubular container, comprising:

a bag-loadable cylinder, having a front face pointing in a discharge direction of the apparatus, the cylinder having a central outlet aligned with a nozzle connection to the tubular container;

a substantially piston-like pressure member axially displaceable against the tubular container in the cylinder and a device for axial displacement of the pressure member; and, a pressure relief spring supported on an inner wall of the cylinder and cooperating therewith, the pressure relief spring having radial spring tongues engaging on the inner wall of the cylinder and the pressure relief spring being made from a springy plastic.

2. The apparatus according to claim 1, wherein the pressure member has a concave construction on a side of the pressure member pointing in the discharge direction.

3. The apparatus according to claim 1, further comprising at least three outwardly projecting guide cams on the pressure member in at least two planes, the planes being located on either side of the elastic seal, the guide cams sliding on the inner wall of the cylinder and preventing tilting of the pressure member.

4. The apparatus according to claim 1, wherein the pressure relief spring is provided on a front face of the pressure member facing in the discharge direction.

5. The apparatus according to claim 4, wherein in an axially unloaded state the pressure relief spring is raised from the pressure member at least in marginal regions of the spring tongues.

6. The apparatus according to claim 1, wherein the pressure relief spring is flat and engages an end of the tubular container facing the pressure member.

7. The apparatus according to claim 6, wherein the pressure relief spring is attached to the pressure member by means of a central, axially directed screw.

8. The apparatus according to claim 1, wherein on a side of the pressure member pointing towards the tubular, container the pressure relief spring is a spring washer and said radial spring tongues are defined by radial slits in said washer and, when relaxed prior to insertion of the pressure member in the cylinder, the spring washer has an external diameter larger than the internal diameter of the cylinder.

9. The apparatus according to claim 8, wherein prior to insertion of the pressure member in the cylinder, the spring washer has an external diameter 8 to 12 percent larger than an internal diameter of the cylinder.

10. The apparatus according to claim 8, wherein the spring washer has marginal regions directed away from the pressure member.

11. The apparatus according to claim 1, wherein the pressure member is provided with an elastic seal providing a sealing action between the pressure member and an inner wall of the cylinder.

12. The apparatus according to claim 11, wherein the elastic seal provides a sealing action between the pressure member and the inner wall of the cylinder upon application of compressed air to a side thereof remote from the tubular bag.

13. The apparatus of claim 11, wherein the elastic seal has an external diameter larger than an internal diameter of the cylinder prior to insertion of the elastic seal in the cylinder.

14. The apparatus according to claim 11, wherein the pressure member has at least one circumferential groove, and further comprising an elastic ring seal acting radially against the inner wall of the cylinder, the ring seal being disposed in the circumferential groove.

15. The apparatus according to claim 14, wherein the ring seal has a sealing lip which is widened under compressed air action.

16. The apparatus according to claim 14, wherein the ring seal is a profile ring, defining a contact surface with the inner wall of the cylinder, substantially independent of compressed air action.

17. Apparatus according to claim 1 for strand-like discharge of pasty materials contained in deformable tubular bags, further comprising:

a cover on the cylinder, provided at the discharge end of the apparatus, the cover having a central opening leading into a discharge nozzle threadable to the cover, and wherein on an inside of the cover, the cover is provided with a planar bearing face for the tubular bag.

18. The apparatus according to claim 17, wherein in a center of the planar bearing face is defined a widened depression for receiving an edge of the tubular bag when cut open.

19. The apparatus according to claim 17, wherein the cover has a substantially cylindrical nozzle for screw - on assembly with the discharge nozzle, adapted to conventional cartridge nozzles.

20. The apparatus according to claim 19, wherein an internal diameter of the cylindrical nozzle in the cover substantially corresponds to conventional cartridges.

21. The apparatus according to claim 17, wherein the cover is constructed in two parts, one part being formed by a retaining nut and the other part by a nozzle connecting piece, the nozzle connecting piece having the planar bearing face for the tubular bag.

22. The apparatus according to claim 21, wherein the nozzle connecting piece is at least partly frontally-insertable into the cylinder.

* * * * *